US005778286A

United States Patent [19]

Kido et al.

[11] Patent Number: 5,778,286

[45] Date of Patent: Jul. 7, 1998

[54] IMAGE FORMING APPARATUS AND PHOTORECEPTOR FOR USE THEREIN

[76] Inventors: Eiichi Kido, 556-204, Yanagimachi, Yamatokoriyama-shi Nara, Japan, 639-11; Yuhi Yui, 2-299, Fukigaoka, Nabari-shi Mie, Japan, 518-04; Toyokazu Mori, 763-1, Minosho-cho, Yamatokoriyama-shi Nara, Japan, 639-11; Mamoru Nozomi, Tana-cho Aoba-ku, Yokohama-shi Kanagawa, Japan, 227

[21] Appl. No.: 923,310

[22] Filed: Sep. 4, 1997

Related U.S. Application Data

[63] Continuation of Ser. No. 609,133, Feb. 29, 1996, abandoned.

[30] Foreign Application Priority Data

Mar. 6, 1995 [JP] Japan ..... 7-045952

[51] Int. Cl.[6] ..... G03G 15/00

[52] U.S. Cl. ..... 399/159; 399/265

[58] Field of Search ..... 399/130, 159, 399/222, 252, 265, 279, 286; 430/57, 58, 66, 523

[56] References Cited

U.S. PATENT DOCUMENTS

| | | | |
|---|---|---|---|
| 5,204,202 | 4/1993 | Ishikawa et al. | 430/66 |
| 5,283,142 | 2/1994 | Mayama et al. | 430/58 |
| 5,321,471 | 6/1994 | Ito et al. . | |
| 5,406,909 | 4/1995 | Shoshi et al. | 430/58 |
| 5,426,488 | 6/1995 | Hayakawa et al. . | |
| 5,450,176 | 9/1995 | Unemo et al. . | |
| 5,515,154 | 5/1996 | Hasegawa et al. . | |
| 5,548,387 | 8/1996 | Fukami et al. . | |
| 5,550,003 | 8/1996 | Inoue | 430/523 X |

FOREIGN PATENT DOCUMENTS

| | | |
|---|---|---|
| 62-205356 | 9/1987 | Japan . |
| 62-205356 A | 9/1987 | Japan . |
| 2-173682 A | 7/1990 | Japan . |
| 4-145462 A | 5/1992 | Japan . |
| 5-100584 A | 4/1993 | Japan . |
| 5-119676 | 5/1993 | Japan . |
| 5-158249 | 6/1993 | Japan . |
| 5-181299 A | 7/1993 | Japan . |
| 5-88398 | 9/1993 | Japan . |

*Primary Examiner*—Sandra L. Brase

*Attorney, Agent, or Firm*—David G. Conlin; George W. Neuner

[57] ABSTRACT

An image forming apparatus adopting a non-magnetic one component developing system is arranged such that a charge brush and a developing roller are aligned along the circumference of a photoreceptor drum, that is rotatably driven, in order from an upstream side in a rotating direction of the photoreceptor drum. A transfer roller is placed opposing the photoreceptor drum with a sheet transportation path in-between. The charge brush, the developing roller and the transfer roller are rotatably driven while contacting the photoreceptor drum respectively. A photoconductive layer of the photoreceptor drum is made of an organic photoconductive material, and a coefficient of friction of the photoreceptor drum and the developing roller is selected to be not more than 0.5. As this eliminates the irregularity in rotary movement of the photoreceptor, offers a quality image and reduces a driving force for the photoreceptor drum, an apparatus of a light weight and high cost can be achieved.

28 Claims, 5 Drawing Sheets

IMAGE FORMING APPARATUS AND PHOTORECEPTOR FOR USE THEREIN

This application is a continuation of application Ser. No. 08/609,133 filed on Feb. 29, 1996, now abandoned.

FIELD OF THE INVENTION

The present invention refers to an image forming apparatus for use in a compact-size copying machine, an optical printer, a facsimile machine, etc., adopting the electrophotographic printing system and also relates to a photoreceptor for use therein.

BACKGROUND OF THE INVENTION

As a result of miniaturization of computers by reducing the size of various devices and units to meet the recent demand, almost every person possesses a personal computer. Now, the miniaturization of printers as output terminals of the personal computers has been strongly demanded.

For the printer device, there are known optical printer devices of a so-called electrophotographic printing system. In such optical printer devices, an optical scanning for a photoreceptor is made by directing thereon a laser beam that is modulated based on information inputted from the computer to form an electrostatic latent image on the photoreceptor. Further, the electrostatic latent image is developed by a developing unit using toner charged beforehand to visualize the image, and the resulting visualized image is transferred onto a transfer unit. The developing system for such laser printers are roughly classified into two types: the two-component developing system and the one-component developing system. The two-component developing system suggests the developing method using two components for the developing material mainly composed of non-magnetic toner and carrier. The one-component developing system suggests a method of using one component for the developing material composed of only non-magnetic toner or magnetic toner.

Most known developing devices for use in compact laser printer typically adopt the non-magnetic one-component developing system. Other than that the developing unit is designed to have short life, the following reasons can be raised.

The two-component developing system has the following disadvantageous features as compared to the one-component developing system.

(1) A toner concentration sensor for controlling a mixed ratio of the toner to the carrier is required. As this increases the required number of components, the developing unit becomes larger in size.

(2) Due to the limited life of the developing material, the developing material is required to be exchanged regularly. Namely, it is not user friendly.

(3) As an agitation mechanism for mixing a developing material with toner is required, the photoreceptor would become larger in size. Namely, as a larger number of components are required, the apparatus becomes larger in size.

On the other hand, in the case of using a magnetic toner in the one-component developing system, the following inconveniences would occur.

(1) As a developing roller or a blade is adopted for the charging member, compared with the case of using a carrier as the charging member, unfavorable conditions of unstable charge and low charging efficiency would occur, which would result in low image quality.

(2) To form the magnetic brush uniform, a high precision of the developing unit is required, and thus the one-component developing system is not suited for a compact-size device.

(3) As compared to the case of adopting the non-magnetic toner, the transferring and fixing efficiency and environmental characteristics would be lowered, and the photoreceptor would suffer a greater damage. Therefore, an improved durability of the main body device would be required, which increases a cost.

For the reasons set forth above, the developing device adopts the non-magnetic one component developing system which is overall advantageous.

FIG. 5 is a view entirely showing a compact-size laser printer adopting the non-magnetic one component developing system as an example of a conventional developing unit. The laser printer includes a feed section 101, an image forming apparatus 102, a laser scanning section 103 and a fixing section 104. The feed section 101 transports a sheet 105 to the image forming apparatus 102 stored in the inside of the laser printer. The image forming apparatus 102 transfers a toner image onto the sheet 105 thus transported. The sheet 105 is further transported to the fixing unit 104, and the toner is fixed onto the sheet 105 by the fixing unit 104. Thereafter, the sheet 105 is discharged by sheet transport rollers 106 and 107 to the outside of the printer. Namely, the sheet 105 is transported through the path shown by an arrow A' indicated by the thick solid line in the figure.

Namely, upon receiving an instruction for executing a printing operation, the sheet 105 set in a feed tray 111 is fed one by one by a feed roller 112, a sheet separation frictional plate 113 and a pressure spring 114 to the inside of the printer. The sheet 105 thus fed makes a detection actuator 115 fall down, and information is outputted therefrom to a sheet detection optical sensor 116 in a form of an electric signal, thereby initiating the image printing operation based on the electric signal. A control circuit 117 actuated by the operation of the sheet detection actuator 115 sends an image signal to a laser diode light emitting unit 131 of the laser scanning section 103 to control ON/OFF of the lightening of a light emitting diode.

Scanning mirrors 132 are arranged so as to rotate at constant and high speed by the scanning mirror motor 133. Namely, in FIG. 5, a laser beam 134 scans the sheet in a direction perpendicular to the sheet surface. The laser beam 134 emitted from the laser diode light emitting unit 131 is directed onto a photoreceptor 121 in the image forming apparatus 102 through reflective mirrors 135, 136 and 137. Here, the laser beam 134 selectively exposes the photoreceptor 121 based on the information indicating ON/OFF of the lightening received from the control circuit 117.

Namely, the charge on the surface of the photoreceptor charged beforehand by the charging member 123 is selectively discharged by the laser beam 134, thereby forming an electrostatic latent image on the photoreceptor 121.

On the other hand, the toner for use in the development is stored in a developing unit 150 in a developing device 124. The toner which is charged beforehand by appropriately agitating it in the developer unit 150 adheres to the surface of a developing roller 151, and by an electric field generated by the developing bias voltage applied to the developing roller 151 and the electric field generated by the potential on the surface of the photoreceptor, a toner image according to the electrostatic latent image is formed on the photoreceptor 121.

The sheet 105 transported to the image forming apparatus 102 from the feed section 101 is fed so as to pass a space between the photoreceptor 121 and the transfer roller 122. Here, by the electric field generated by the transfer voltage applied to the transfer roller 122, the toner on the photoreceptor 121 is electrically attracted to be transferred to the sheet 105. In this state, the toner on the photoreceptor 121 is transferred onto the sheet 105 by the transfer roller 122, and while the residual toner remaining on the photoreceptor 121 without being transferred is collected by a cleaning unit 126.

Thereafter, the sheet is transported to the fixing unit 104. Then, by the pressure roller 141 and the heat roller 142 heated to one hundred and several tens degree, an appropriate heat and pressure are applied to the sheet 105. As a result, toner is melted to be fixed onto the sheet 105, thereby forming thereon a permanent image. Then, the sheet 105 is discharged to the outside of the apparatus by the sheet transport rollers 106 and 107.

However, as described earlier, most image forming apparatuses adopting the currently introduced non-magnetic one-component developing system are arranged such that a developing roller which holds toner comes in contact with an electrostatic latent image formed on the photoreceptor. Additionally, in the developing device, a blade is made in tight contact with the developing roller, and a toner supply roller is provided so as to be in contact with the developing roller.

According to the described developing system, although the toner can be charged relatively with ease, as the developing roller is in contact with the photoreceptor, there exits a problem associated with the drive torque of the developing device. Namely, as the developing roller is in contact with the photoreceptor, the drive motor of the photoreceptor is required to have the power more than necessary. Besides, a jitter tends to generate in the image, which would lower the quality thereof. As described, the drive system of the image forming apparatus requires the strength more than necessary. Furthermore, as the drive motor is large in size and expensive, the developing device is not suited for use in the compact and low consumption apparatus of the recent demand.

Additionally, the peripheral speed of the developing roller is selected to be faster than that of the photoreceptor so that the toner adhering to the surface of the roller can be carried onto the photoreceptor as much as possible. Therefore, as the contact pressure exerted from the developing roller becomes larger with respect to the photoreceptor, the photoreceptor is urged to rotate by the developing roller. On the other hand, the photoreceptor rotates at a constant speed by constantly receiving rotations from the drive source. Therefore, the peripheral speed of the photoreceptor varies between the peripheral speed of the photoreceptor and the peripheral speed of the developing roller, and irregularity in rotary movement occurs due to the backlash of the drive gear and the driven gear.

Conventionally, the described irregularity in the rotary movement of the photoreceptor is prevented by making smaller the backlash itself by improving the precision of the gears. Furthermore, by driving the photoreceptor with a sufficient drive force while applying the load thereto, the rotations of the photoreceptor can be stabilized. However, in the described arrangement, the device itself would become larger in size, and the cost would increase, thereby hindering the development aiming at light-weight and low cost characteristics. Furthermore, after producing many copies, the torque of the developing device would increase, and the irregularity in the rotary movement of the photoreceptor would be emphasized, resulting in still lower image reproducing efficiency.

SUMMARY OF THE INVENTION

An object of the present invention is to provide an image forming apparatus wherein a cylindrical photoreceptor rotates while making a contact with a developing material holding member, which enables a rotary movement of the photoreceptor to be actuated by a compact-size drive motor of low torque without having the irregularity in rotary movement of the photoreceptor, thereby ensuring a high quality image.

To achieve the first object, the image forming apparatus in accordance with the present invention includes:

a cylindrical photoreceptor which is rotatably driven; and a developing material holding member (for example, developing roller) for holding a developing material (for example, non-magnetic one-component tone), the developing material holding member supplying a developing material on the photoreceptor during its rotary movement by making a contact with a peripheral surface of the photoreceptor, wherein the photoreceptor is placed in such a manner that a coefficient of dynamic friction between the photoreceptor and the developing material holding member is not more than 0.5.

In the described arrangement, as the developing material holding member and the photoreceptor are in contact with one another, a large force is required for the image forming apparatus in order to drive the developing material holding member. Therefore, in the described arrangement, the coefficient of a dynamic friction between the photoreceptor and the developing material holding member is reduced to not more than 0.5. As a result, as the frictional resistance between the photoreceptor and the developing material holding member can be made small, a drive torque for driving the photoreceptor can be reduced, thereby reducing the cost of the apparatus. As a result, as the drive motor for driving the photoreceptor can be made compact and of low torque, the cost of the apparatus can be reduced. Additionally, the irregularity in rotary movement of the photoreceptor drum can be reduced, thereby achieving a clear and quality image.

In general, in order to make the developing material on the surface of the developing material holding member adhere to the photoreceptor as much as possible, the peripheral speed of the developing material holding member is selected to be faster than the peripheral speed of the photoreceptor (from 1.1 times to 2.0 times). Here, in the case where a frictional resistance between the photoreceptor and the developing material holding member is large, by the rotary movement of the developing material holding member pressed onto the photoreceptor, the photoreceptor is driven by the developing material holding member. Therefore, irregularity in rotary movement would occur due to the backlash of the drive gear for the photoreceptor and the driven gear formed between the photoreceptor and the developing material holding member. Therefore, by selecting the coefficient of dynamic friction between the photoreceptor and the developing material holding member to be not more than 0.5, the frictional resistance between the photoreceptor and the developing material holding member can be reduced, thereby suppressing the force exerted on the photoreceptor to be driven by the developing material holding member. As a result, the irregularity in rotary movement of the photoreceptor can be reduced, and stable rotations of the photoreceptor can be ensured, thereby achieving a clear and quality image.

In the preferred modification, the image forming apparatus having the described arrangement may further include:

a charging member (charge brush, etc.,) for uniformly charging the surface of the photoreceptor during its rotary movement, the charging member being provided on an upstream side of the developing material holding member with respect to a rotating direction of the photoreceptor so as to be in contact with the peripheral surface of the photoreceptor; and charging member control means for controlling the charging member to rotate at a different peripheral speed from a peripheral speed of the photoreceptor.

According to the described arrangement, by rotating the photoreceptor and the charging member at different peripheral speed, the charging member urges the photoreceptor to stop rotating. Therefore, by maintaining the number of rotations of the photoreceptor constant, the drive torque of the photoreceptor should be high, and the drive force exerted onto the photoreceptor of the developing material holding member appears to be small, thereby suppressing the force inducing the photoreceptor to be driven by the developing material holding member. This enables the irregularity in rotary movement of the photoreceptor to be still reduced, thereby obtaining a still clear image of higher quality.

In a still preferred modification, the image forming apparatus having the aforementioned arrangement may further include:

a transfer member placed opposing the photoreceptor having a transport path for a copying material in-between, for transferring the developing material on the photoreceptor to the copying material by a rotary movement thereof; and transfer member control means for controlling the transfer member to rotate at different peripheral speed from a peripheral speed of the photoreceptor.

According to the described arrangement, by rotating the transfer member at different peripheral speed from the peripheral speed of the photoreceptor, the transfer member urges the photoreceptor to stop rotating. Therefore, by maintaining the number of rotations of the photoreceptor constant, the drive torque of the photoreceptor should be high, and the drive force exerted onto the photoreceptor of the developing material holding member appears to be small, thereby suppressing the force inducing the photoreceptor to be driven by the developing material holding member. As a result, the irregularity in rotary movement of the photoreceptor can be still reduced, thereby obtaining a clear quality image.

In the image forming apparatus having the described arrangement, it is preferable that the photoreceptor is composed of a photoconductive layer made of an organic photoconductive material. According to the described arrangement, as the photoconductive layer of the photoreceptor is made of the organic photoconductive material, a coefficient of dynamic friction between the developing material holding member and the photoreceptor can be reduced to be not more than 0.5.

In the image forming apparatus having the described arrangement, the surface layer of the photoreceptor in contact with the developing material holding member preferably includes at least one element selected from a group consisting of a polycarbonate copolymer obtained by a block-polymerization of polycarbonate with a polysiloxane unit as a main chain or a polycarbonate copolymer obtained by a graft-polymerization of polycarbonate with a polysiloxane unit as a side chain, a solid lubricating agent, a resin obtained by a graft-polymerization of a macromer having silicone as a side chain with a polymer and a resin obtained by a graft-polymerization of a macromer having alkylene fluoride as a side chain.

According to the described arrangement, as an improved sliding surface of the photoreceptor can be achieved, a coefficient of dynamic friction between the developing material holding member and the photoreceptor can be made still smaller.

The second object of the present invention is to provide a photoreceptor for use in an image forming apparatus for supplying a developing material onto the photoreceptor by rotating a developing material (for example, non-magnetic toner of one-component) while bringing it in contact with the developing material holding member, which can be driven by a compact-size drive motor of a small torque, without the problem of irregurality in rotary movement thereof, thereby ensuring a quality image.

To fulfill the second object, the photoreceptor in accordance with the present invention is characterized by including: a cylindrical tube which is capable of rotating, and a photoconductive layer formed so as to cover the cylindrical tube, wherein the photoconductive layer has a coefficient of dynamic friction with respect to the developing material holding member of not more than 0.5.

According to the described arrangement, the photoreceptor is arranged such that the coefficient of dynamic friction with respect to the developer material holding member is not more than 0.5. On the other hand, in the image forming apparatus wherein the developing material holding member and the photoreceptor contact with one another, as the coefficient of dynamic friction between the developing material holding member and the photoreceptor is large, the irregularity in rotary movement of the photoreceptor would occur. By adopting such photoreceptor in the image forming apparatus, the irregularity in rotary movement of the photoreceptor can be effectively suppressed.

For a fuller understanding of the nature and advantages of the invention, reference should be made to the ensuring detailed description taken in conjunction with the accompanying drawings.

DESCRIPTION OF THE EMBODIMENTS

Embodiment 1

Figure 1:
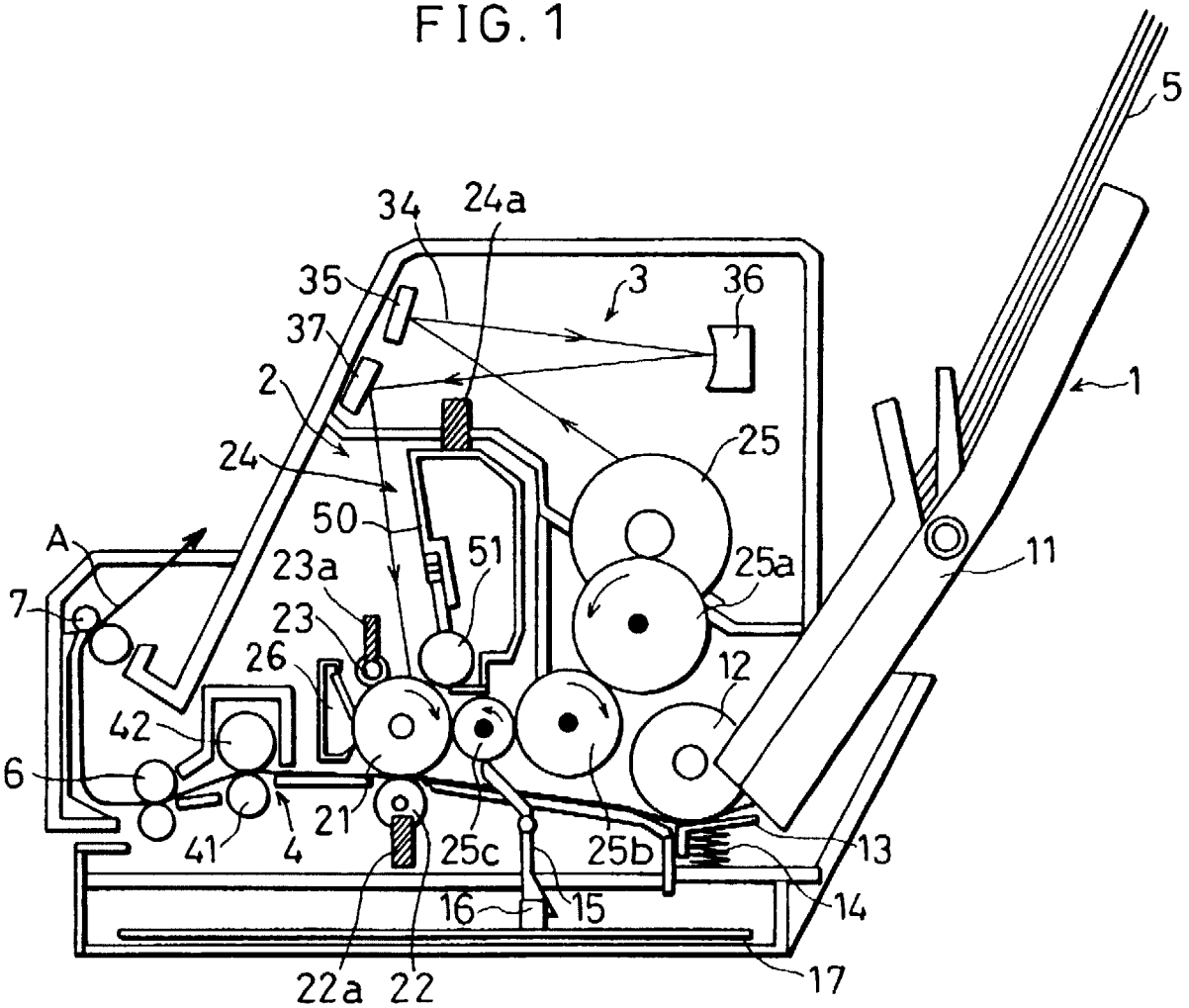
FIG. 1 is a view schematically showing a laser printer in accordance with one embodiment of the present invention.
Figure 2:
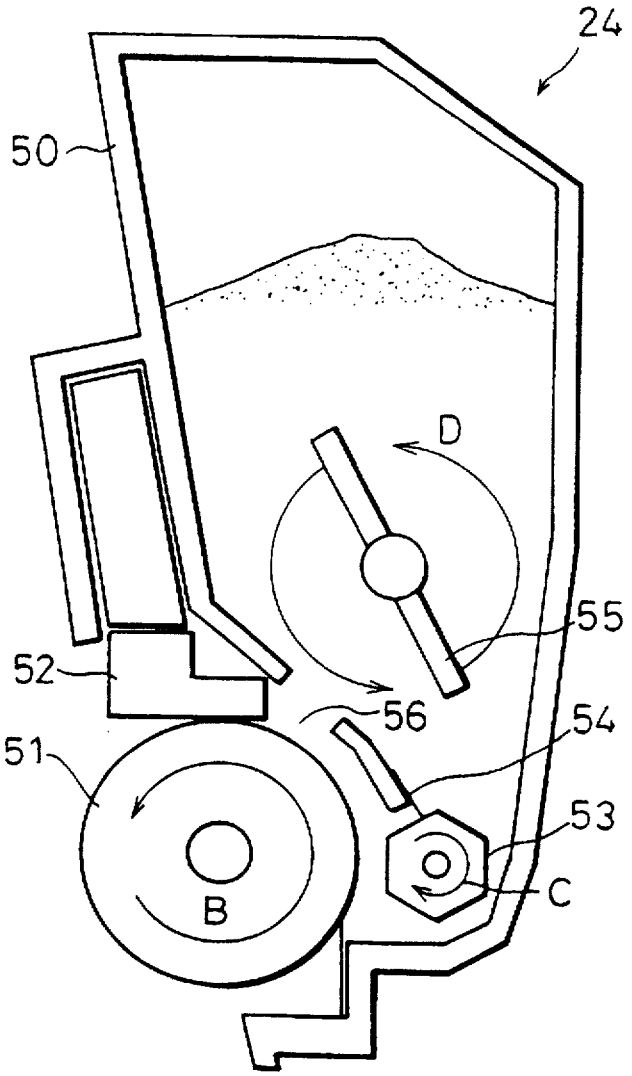
FIG. 2 is a view schematically showing a developing device of the laser printer.

The following descriptions will discuss one embodiment of the present invention in reference to FIG. 1 and FIG. 2. The present embodiment will be explained through the case where the image forming apparatus is applied to a laser printer.

As shown in FIG. 1, the laser printer includes a feed section 1, an image forming apparatus 2 of the present invention, a laser scanning section 3 and a fixing unit 4. The feed section 1 is provided for transporting a sheet 5 to the image forming apparatus 2 installed in the printer, and the image forming apparatus 2 transfers a toner image onto the transported sheet 5 to form an image. Then, the sheet 5 is transported to the fixing unit 4, where the toner (developing material) is affixed thereon. Thereafter, the sheet 5 is discharged to the outside of the printer by sheet transport rollers 6 and 7. Namely, the sheet 5 is transported in the path shown by an arrow A with a thick solid line in the figure.

The feed section 1 includes a feed tray 11, a feed roller 12, a sheet separating frictional plate 13 and a pressure spring 14, a sheet detecting actuator 15, a sheet detection sensor 16 and a control circuit 17.

Upon receiving an instruction for initiating a printing operation, the sheet 5 set in the feed tray 11 is fed one by one to the inside of the printer by the feed roller 12, the sheet separation frictional plate 13 and the pressure spring 14 placed under the feed tray 11. The sheet 5 makes the sheet detecting actuator 15 fall down, and the information generated therein is outputted to a sheet detection optical sensor in a form of an electric signal, thereby giving an instruction to initiate the printing operation of an image based on an electric signal. The control circuit 17 activated by the operation of the sheet detecting actuator 15 sends an image signal to a laser emitting diode (not shown) of the laser scanning section 3, and controls ON/OFF of the lightening of the light emitting diode.

The laser scanning section 3 includes reflective mirrors 35, 36 and 37 other than the laser emitting diode. As shown in FIG. 1, the laser beam 34 emitted from the laser emitting diode scans the photoreceptor drum 21 (photoreceptor) of the image forming apparatus 2 through the reflective mirrors 35, 36 and 37 in a direction perpendicular to the sheet surface. Here, the laser beam 34 selectively exposes the photoreceptor drum 21 based on information indicating ON/OFF of the lightening outputted from the control circuit 17.

The image forming apparatus 2 includes a developing device 24, a pulse motor 25 and a cleaning unit 26. The developing device 24 includes a photoreceptor drum 21, a transfer roller 22, a main charger 23, and a developing roller 51 (developing material holding member). The function of the image forming apparatus 2 will be explained in detail later.

The laser beam 34 selectively discharges the charge on the surface of the photoreceptor drum 21 charged beforehand by the charger unit 23 to form an electrostatic latent image on the photoreceptor 21.

On the other hand, the toner for use in the development is stored in a developer unit 50 of the developing device 24. The toner charged with an appropriate agitation in the developer unit 50 adheres to the surface of the developing roller 51. Then, by the electric field generated by a developing bias voltage and the potential on the surface of the photoreceptor, a toner image is formed on the photoreceptor 21 according to the electrostatic latent image.

The sheet 5 transported to the image forming apparatus 2 by the feed section 1 enters a clearance between the photoreceptor drum 21 and the transfer roller 22. Then, by an electric field generated from the transfer voltage applied to the transfer roller 22, the toner on the photoreceptor drum 21 is electrically attracted, and is transferred onto the sheet 5. Here, the toner on the photoreceptor drum 21 is transferred to the sheet 5 by the transfer roller 22, and the residual toner remaining after the transfer is collected by the cleaning unit 26.

Thereafter, the sheet 5 is transported to the fixing unit 4. In the fixing unit 4, an appropriate temperature and pressure are applied by a pressure roller 41 and a heat roller 42 maintained at one hundred and several tens degree. Then, the toner is melted, and an image is permanently affixed to the sheet 5. The sheet 5 is transported by the sheet transport rollers 6 and 7 to be discharged to the outside of the apparatus.

The image forming apparatus 2 will be described in more detail.

The cleaning unit 26, the charger unit 23 and the developing device 24 are aligned along the circumference of the photoreceptor drum 21 to be in contact therewith from the upstream side in a rotating direction of the photoreceptor drum 21 in this order. More specifically, the scraping plate of the cleaning unit 26, the charge brush of the charger unit 23, and the developing roller 51 of the developing device 24 are in contact with the photoreceptor drum 21. The transfer roller 22 is placed opposing the photoreceptor drum 21 and contacting therewith having the sheet 5 transported in-between.

Here, the charge brush of the charger unit 23 is in tight contact with the photoreceptor drum 21 by a spring 23*a*. Further, by a spring 24*a* formed on the upper portion of the developing device 24, the developing roller 51 is pressed onto the photoreceptor drum 21. The transfer roller 22 is also pressed onto the photoreceptor 21 by a spring 22*a*.

Two gears are mounted on a shaft of the photoreceptor 21, one is a drive gear (not shown) for receiving a drive force from the pulse motor 25 through the gears 25*a*, 25*b* and 25*c*, and the other is a gear (not shown) for driving the transfer roller 22. By driving the pulse motor 25, the gear 25*a* rotates in a counterclockwise direction, and the gear 25*b* is driven in a clockwise direction, thereby rotating the gear 25*c* in a counterclockwise direction. By practicing the described sequential operation, a rotary movement of the photoreceptor 21 is actuated in a clockwise direction. In the present embodiment, the photoreceptor drum 21 is rotatably driven by a force from the pulse motor, whose speed has been reduced by the described three gears, and this rotary movement thereof is controlled at a peripheral speed of 25 mm/sec. Here, the developing device 24 is driven by other drive gear (not shown).

The described photoreceptor 21 is structured such that a photoconductive layer is formed so as to cover the surface of a cylindrical tube. The cylindrical tube is an aluminum cylindrical tube with a diameter of 24 mm and a thickness of 0.75 mm.

For the photoconductive layer, an inorganic and organic photoconductive material of various kinds may be used. Examples of the inorganic photoconductive material include amorphous selenium, selenium-tellurium, selenium-arsenic, selenium-antimony, cadmium sulfide, zinc oxide, and the like. Examples of the organic photoconductive material include polyvinyl carbazole, and the like. There is known laminated-type photoreceptor wherein the charge generating layer and the charge transporting layer are laminated. Such laminated type organic photoconductive material is disclosed by, for example, U.S. Pat. No. 4,251,612.

In the case of the laminated organic photoconductive material, examples of the charge generating substance for use in the charge generating layer includes: selenium and an alloy thereof, arsenic-selenium, cadmium sulfide, zinc oxide, and other inorganic photoconductive materials, and organic pigments and dyes of various kinds such as phthalocyanine, azo dye, quinacridone, polycyclic quinone, pyrylium salt, thiopyrylium salt, indigo, thioindigo, anthrone, C.I. pigment orange 40 (pyranthrone), cyanine pigment, etc. Among the above-listed examples, phthalocyanine, azo dye are especially preferable.

Examples of the charge transport material for use in the charge transport layer include: electron donative substances, for example, a heterocyclic compound such as carbazole, indole, imidazole, oxazole, pyrazoline, etc., aniline derivative, a hydrazone compound, aromatic amine derivative, stilbene derivative, or a polymer having a group composed of the above-listed compound as a main chain or a side chain, and the like.

Examples of the polymer material for use in dispersing the charge transport material include: vinyl polymers such as polymethyl methacrylate, polystylene, polyvinyl chloride, and the like, copolymers thereof, various polycarbonate resin, polyester resin, polyestercarbonate, polysulfonic resin, polyimide resin, phenoxy resin, epoxy resin, silicone resin, or a partially cross-linked hardened product.

Examples of the photoreceptor with a coefficient of dynamic friction with a developing roller 51 of not more than 0.5 for use in the image forming apparatus of the present embodiment include:

(1) A photoreceptor having a surface layer which includes at least one kind selected from a copolymer of polycarbonate obtained by block-polymerization of polycarbonate with a polysiloxane unit as a main chain known through, for example, Japanese Laid-Open Patent Publication No. 88398/1993 (Tokukaihei 5-88398), or a polycarbonate copolymer obtained by a graft-polymerization of polycarbonate with a polysiloxane unit as a side chain (known through, for example, Japanese Laid-Open Patent Publication No. 158249/1993 (Tokukaihei 5-158249);

(2) A photoreceptor having a surface layer including a solid lubricating agent. Examples of such solid lubricating agent include: alkylene fluoride resin such as polytetrafuloroetylene, polyvinyl fluoride, polyvinylidene fluoride, etc., polyethylene, polyethylene terephthalate, and the like.

(3) A photoreceptor including a resin obtained by a graft polymerization of a macromer including silicone as a side chain. Examples of such resin include: those obtained by a copolymerization of a macromer obtained by a graft-polymerization of acrylic acid ester or methacrylic acid ester with a silicone as a side chain with a vinyl polymerizable monomer such as acrylic acid ester, methacrylic acid ester, styrene, etc., known through, for example, Japanese Laid-Open Patent Publication No. 205356/1987 (Tokukaisho 62-205356).

(4) A photoreceptor having a surface layer which includes a resin obtained by a graft-polymerization of a macromer having an alkylene fluoride as a side chain. Examples of such resin include: those obtained by a copolymerization of a macromer obtained by a graft-polymerization of an acrylic acid ester or methacrylic acid ester with fluoroalkyl unit as a side chain with a vinyl polymerizable monomer such as acrylic acid ester, methacrylic acid ester, styrene, and the like.

Here, the surface layer suggests a charge transport layer in the case of the photoconductive layer of laminated type, and otherwise suggests an entire photoconductive layer.

The charger unit 23 suggests a contact-type brush charger with a charge brush. For such charge brush, an electrically conductive fiber of a resistance value of $10^6$ Ω wherein carbon is dispersed in rayon is used. The electrically conductive fiber has a thickness of 6.7 μm, and a length of 2.5 mm. The density of the charge brush is 20,000 hairs/cm$^2$. The charge brush of the charger unit 23 is pressed by a spring 23a onto the photoreceptor 21 by a force of 400 gf.

For the transfer roller 22, an electrically conductive sponge roller having a diameter of 12 mm is used. Such sponge roller is made of a polyurethane having a carbon dispersed therein. The amount of carbon is selected such that the resistance value of the transfer roller 22 is $10^4$ Ω. The hardness of the transfer roller 22 is selected to be between 40 degree and 50 degree in ASKER C. The transfer roller 22 is pressed by a force of 1.5 kgf by the spring 22a onto the photoreceptor 21.

The ASKER C indicates the hardeners of a sample which is measured by a hardness measuring device (a macromolecule measuring instrument) produced in accordance with the standard (SRIS 0101) of Japanese Rubber Association. Specifically, the hardness measuring device indicates the hardness of a sample by pressing a ball-point needle designed for hardness measurement against a surface of the sample using a force of a spring and measuring the depth of indentation produced by the needle when the resistive force of the sample and the force of spring balance. With the standard of ASKER C, when the depth of indentation produced by the needle with the application of load of 55 g on the spring becomes equal to the maximum displacement of the needle, the hardness of the sample is indicated as zero degree. Also, when the depth of indentation produced by the application of load of 855 g is zero, the hardness of the sample is indicated as one hundred degree.

The developing device 24 is pressed onto the photoreceptor 21 by a spring 24a of the main body with a force of 800 gf in the installed state in the main body of the image forming apparatus. As a result, there exits a nip width of 1.5 mm between the photoreceptor drum 21 and the transfer roller 22. The developing device 24 employs the non-magnetic one component developing system.

As shown in FIG. 2, the developing device 24 includes a developer unit 50. In the developer unit 50, provided is an agitator 55 for carrying toner to the polygon roller 53 (to be described later) with agitation. The agitator 52 rotates in a direction of an arrow D in the figure. Additionally, a developing roller 51 is provided so as to close the opening formed at a bottom portion of the developer unit 50.

The developing roller 51 rotates in a direction of an arrow B with a variable peripheral speed, so as to carry the non-magnetic one component toner stored in the developer unit 50 to the developing area in contact with the photoreceptor 21. On an upstream side with respect to the developing area, provided is a developing material layer thickness controlling member 52 which is pressed onto the developing roller 51. The developing material layer thickness controlling member 52 forms a uniform toner layer entirely on the area in the shaft direction of the developing roller 51.

On an upstream side of the developing material layer thickness controlling member 52 with respect to the rotating direction of the developing roller 51, a scraping plate 54 extending from the side wall of the developer unit 50 is provided. The scraping plate 54 includes plural holes formed therein. Provided is the polygon roller 53 in the direction of the extended scraping plate 54 on the upstream side of the developing roller 51. The polygon roller 53 rotates in the direction of an arrow C and carries the toner. The toner carried by the polygon roller 53 from the agitator 55 is scraped by the scraping plate 54, and thereafter, the toner is carried in the direction of the developing material layer thickness controlling member 52 by the developing roller 51. A part of the toner thus carried is applied to the developing roller 51 so as to have a predetermined thickness by the developing material layer thickness controlling member 52. On the other hand, the rest of the toner is moved back by the developing material layer thickness controlling member 52 in the direction of the agitator 55 through a hole 56 formed in the scraping plate 54.

In the present embodiment, the developing roller 51 has a diameter of 16 mm, and is pressed onto the photoreceptor 21 with a predetermined nip width of 0.3 mm.

To ensure a predetermined nip width from the photoreceptor 21, the developing roller 51 is made of a material having a rubber elasticity. Specifically, the developing roller 51 is made of an electrically conductive elastic material having applied thereto an electrical conductivity to an elastic material such as urethane rubber, silicone rubber, NBR acrylonitrile-butadiene rubber, and the like. It is preferable that the developing roller 51 has a hardness in a range of 50–90 degree in ASKER C and a resistance value in a range of $10^4$–$10^8$ Ω more preferably in a range of $10^6$–$10^7$ Ω.

The developing material layer thickness controlling member 52 is pressed onto the developing roller 51 by a force of 30 gf/cm. The developing material layer thickness controlling member 52 is made of an alloy having a ridigity such as SUS (stainless steel), aluminum, and the like.

The polygon roller 53 is selected to have a diameter of 12 mm and a peripheral speed of 40 mm/sec. As to the polygon roller 53, the more apexes the roller has, the lower is the toner carrying efficiency, and the fewer apexes the roller has, the higher is the toner carrying efficiency. However, if the apexes of the roller is too few, it would result in variation in amount of carried toner. In consideration of the above, the polygon roller 53 is preferably has 5–8 apexes.

Here, with regard to the frictional property, a comparison is made between the photoreceptor of the image forming apparatus of the present embodiment and the photoreceptor of the conventional image forming apparatus.

The frictional properties of the respective photoreceptors are evaluated under the conditions presented below.

A sheet-like photoreceptor is fixed on the glass, and an urethane rubber with a width of 31 mm and a thickness of 2 mm is pressed thereon. Namely, the described sheet-like photoreceptor is placed between the glass and the urethane rubber. The sheet is tensiled at a rate of 100 mm/min, and under this condition, the rubber pressing force and the tensile force are measured by the measuring device.

Here, an equality of F=μM is satisfied, wherein M represents a rubber pressing force, F represents a tensile force and p represents a coefficient of dynamic friction. Namely, in the graph wherein the x-axis indicates the rubber pressing force, and the y-axis indicates the tensile force, the coefficient of dynamic friction p is the slope of the graph. Here, it is assumed that there is no displacement in glass and photoreceptor.

In the present embodiment, the coefficient of dynamic friction μ is required to be not more than 0.5 more preferably not more than 0.2.

For the photoreceptor, a sheet-like photoreceptor (hereinafter referred to as an improvement B) is adopted wherein a charge transport layer formed by dispersing a hydrazon in copolymer obtained by a graft-polymerization of polycarbonate with a polysiloxane as a side chain and a charge generating layer wherein fine particles of phthaloxyane are dispersed in polyvinylbutyral are laminated.

Such copolymer is represented by the formula (1) wherein X represents the formula (2). The hydrazone is represented by the formula (3).

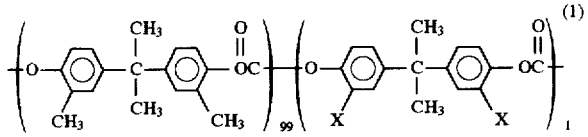

(1)

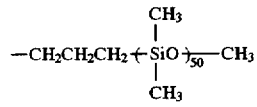

(2)

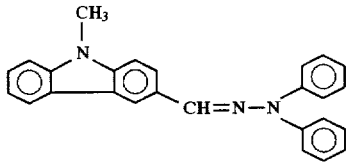

(3)

The results of measurements of the coefficient of dynamic friction of the improvement B are shown in Table 1.

Next, a coefficient of dynamic friction of a photoreceptor (hereinafter referred to as an improvement A) having the same arrangement as the improvement B except that a polycarbonate of copolymer obtained by a block-polymerization of polycarbonate with a polysiloxane unit as a main chain is used in replace of a binder of the charge transport layer. The results of measurement are shown in Table 1.

A coefficient of dynamic friction of another photoreceptor (hereinafter referred to as improvement C) is measured. The improvement C has the same arrangement as the improvement B except that a mixed compound of a grafted copolymer obtained by a graft-polymerization of a copolymer of an ester of methacrylic acid with styrene with a silicone unit as a side chain and a polycarbonate (Novarex (registered trademark) 7025 available from Mitsubishi Chemical Industries, Ltd.) is used in replace of the binder of the charge transport layer of the improvement B. The results are shown in Table 1.

A coefficient of dynamic friction of another photoreceptor (hereinafter referred to as conventional Example A) is measured. The conventional Example A has the same arrangement as improvement B except that polymethyl methacrylate (Mitsubishi Rayon Company Ltd., BR-85) is used in replace of the binder of the charge transport layer. The results are shown in Table 1.

A coefficient of dynamic friction of another photoreceptor (hereinafter referred to as conventional Example B) is measured, having the same arrangement as improvement B except that polycarbonate (Novarex (registered trademark) 7025 available from Mitsubishi Chemical Industries, Ltd.) is used in replace of the binder of the charge transport layer.

TABLE 1

| RUBBER PRESSING FORCE M (gf) | | 10 | 20 | 50 | 70 | 100 | 150 | COEFFICIENT OF DYNAMIC FRICTION μ |
|---|---|---|---|---|---|---|---|---|
| TENSILE FORCE (F) | CONVENTIONAL EXAMPLE A (gf) | 5 | 18 | 35 | 42 | 68 | 98 | AROUND 0.67 |

TABLE 1-continued

| RUBBER PRESSING FORCE M (gf) | 10 | 20 | 50 | 70 | 100 | 150 | COEFFICIENT OF DYNAMIC FRICTION μ |
|---|---|---|---|---|---|---|---|
| CONVENTIONAL EXAMPLE B (gf) | 5 | 17 | 36 | 42 | 62 | 105 | AROUND 0.67 |
| IMPROVEMENT A (gf) | 2 | 5 | 10 | 16 | 25 | — | AROUND 0.24 |
| IMPROVEMENT B (gf) | 2 | 2 | 7 | 8 | 12 | 12 | AROUND 0.12 |
| IMPROVEMENT C (gf) | 2 | 2 | 5 | 8 | 14 | 14 | AROUND 0.12 |

From the results shown in Table 1, the coefficient of the dynamic friction between conventional examples A and B and the urethane rubber is around 0.67. The coefficient of the dynamic friction of the improvement A is around 0.24, and those of the improvements B and C are around 0.12. Therefore, in the improvement A, the resistance by friction is about one third of the conventional photoreceptor, and in improvements B and C, the resistance by friction is about one sixth of the conventional photoreceptor.

Although a sheet-like photoreceptor is used in the described experiment, almost same results would be obtained when using the photoreceptor drum 21. Specifically, the photoreceptor drum 21 is fixed, and an urethane rubber with a width of 31 mm and a thickness of 2 mm is made in tight contact with the surface thereof. Further, the photoreceptor drum 21 is rotated at 100 mm/min to evaluate the correlation between the rubber pressing force and the extension force. The results of this experiment would give almost the same results as the described experiment.

As described, according to the image forming apparatus of the present embodiment, as the friction between the photoreceptor drum and the developing roller is small, the drive torque of the shaft of the photoreceptor drum can be reduced. As a result, the drive motor of the image forming apparatus can be made compact and low torque. Furthermore, as the frictional resistance between the developing roller and the photoreceptor is small, the force exerted onto the photoreceptor to be driven by the developing roller can be reduced. As a result, a stable rotary movement of the photoreceptor can be ensured without employing a high precision gear required in conventional model, thereby achieving a quality image.

Although a sheet-like photoreceptor is used in the above-explained experiment, a practically-used cylindrical photoreceptor can be employed to achieve the same effect. Namely, on a fixed cylindrical photoreceptor, an urethane rubber with a width of 31 mm and a thickness of 2 mm is formed in tight contact therewith. In consideration of the results of measurements on the correlation between the pressing force and the tensile force under the condition that the drum-shaped photoreceptor is rotated at 100 mm/min., the same effect as the aforementioned examples can be achieved.

Next, the respective performances of the photoreceptor drum and the photoreceptor drum 21 of the present embodiment are compared using the image forming apparatus 2.

As the photoreceptor drum (21) of the present embodiment, a photoreceptor drum having the following arrangement is adopted. An organic photoconductive material with a thickness of 20 μm wherein hydrazone is dispersed in an organic photoconductive material having a copolymer obtained by a graft-polymerization of polycarbonate with polysiloxane unit as a side chain is applied on a cylindrical tube as the charge transport layer, and an organic photoconductive material wherein fine particles of phthalocyanine are dispersed in polyvinyl butyral is formed thereon as a charge generating layer with a thickness of 0.5 μm. For a conventional photoreceptor drum, a photoreceptor drum made of similar materials to those of conventional examples A and B used in previous experiment is adopted.

In the experiment, a pulse motor available from Matsushita Electric industrial Co., Ltd. is used. The pulse motor is arranged so as to have a drive torque of 400 gf cm under the conditions that input voltage of 12 V, a wire wound resistance of 7.8 Ω, and a current of 0.65 A.

In the experiment, with a variable ratio of the peripheral speed of the developing roller 51 and the photoreceptor drum 21, evaluations are made by monitoring a torque of the motor axis of the photoreceptor drum 21. This is because the largest torque among those observed by the torque of the motor axis of the photoreceptor drum 21 is a slip torque caused by the difference in peripheral speed between the developing roller and the photoreceptor. With a variable ratio of the peripheral speed of the developing roller with respect to the photoreceptor from 1.0 to 1.7, results of comparison on torque on the motor axis between the conventional photoreceptor and the photoreceptor of the present embodiment are shown in Table 2.

TABLE 2

| PERIPHERAL SPEED RATIO | 1.0 | 1.3 | 1.5 | 1.7 |
|---|---|---|---|---|
| TORQUE OF CONVENTIONAL EXAMPLE (kgf cm) | 0.10 | 0.13 | 0.17 | 0.20 |
| TORQUE OF EMBODIMENT 1 (kgf cm) | 0.03 | 0.04 | 0.05 | 0.06 |

From the results shown in Table 2, it can be seen that when the peripheral speed ratio varies in the range of 1.0–1.7, the torque of the photoreceptor in the present embodiment is less than one third of that of the conventional photoreceptor. This effect of the present embodiment is achieved by making the friction between the photoreceptor and the developing roller smaller than that of conventional photoreceptor.

With a variable peripheral speed of the developing roller with respect to the photoreceptor, the uniformities of a half-tone image and a black image are respectively evaluated. Here, the half-tone image suggests an image wherein a black line portion and a white portion surrounded by the black line are alternatively formed on the sheet in a direction perpendicular to the sheet transporting direction. The half-tone image is desirably arranged such that the width of the black line portion and the width of the white portion have the same width, and respective intervals between black lines, i.e., the respective width of the white portion are preferably the same. The uniformity of the half-tone image indicates a variation in interval between black lines. By measuring the interval between black lines, i.e., a pitch error, unstable condition of the rotary movement of the photoreceptor can be evaluated. On the other hand, in the case of the black image, the uniformity is evaluated based on variation in density. The results of these measurements are shown in Table 3.

TABLE 3

| PERIPHERAL SPEED RATIO | 1.0 | 1.3 | 1.5 | 1.7 |
|---|---|---|---|---|
| CONVENTIONAL PHOTORECEPTOR | Δ | x | x | x |
| PHOTORECEPTOR OF EMBODIMENT 1 | ○ | ○ | ○ | ○ |

Uniformity . . .
x : Very Poor (irregularity is observed both in pitch and in density)
Δ: Good (uniform density with irregularity in pitch)
○ : Excellent (uniform density without irregularity in pitch)

As a result, in the conventional photoreceptor, in the case of the peripheral speed ratio of 1.0, although an image quality is stable, there exits the problem of irregularity associated with rotary movement of the photoreceptor. With the peripheral speed ratio of not less than 1.3, there shown unpreferable conditions of not only irregular rotary movement of the photoreceptor, but also poor image quality. In contrast, with regard to the photoreceptor of the present embodiment, even with the peripheral speed ratio of 1.7, such unpreferable conditions of pitch error and uncontrolled density do not occur. Thus, the image forming apparatus of the present embodiment offers desirable images without suffering from the irregularity in rotary movement of the photoreceptor.

Embodiment 2

Figure 3:
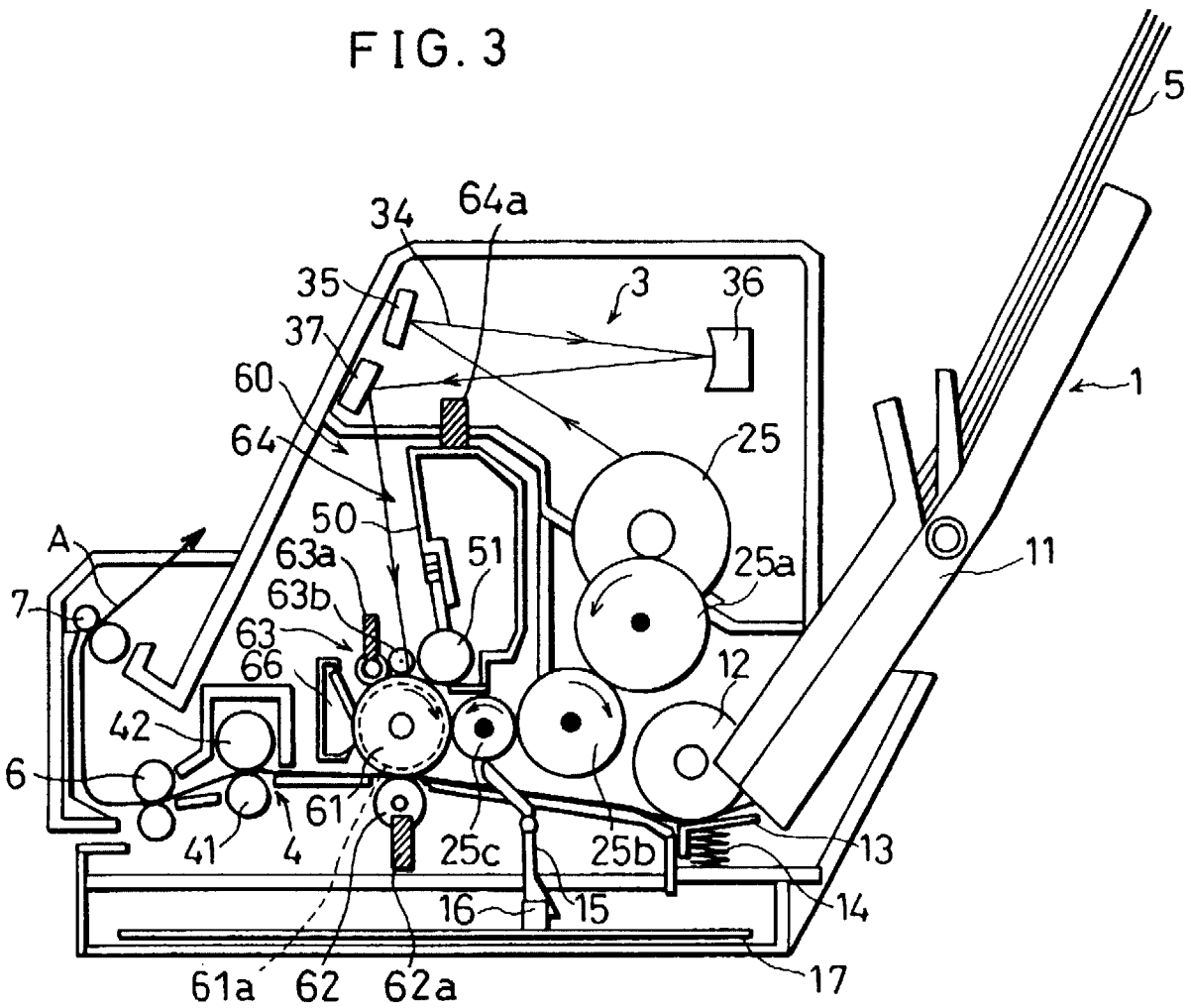
FIG. 3 is a view schematically showing a laser printer in accordance with another embodiment of the present invention.

The following descriptions will discuss another embodiment of the present invention in reference to FIG. 3. For convenience in explanations, members having the same function as those of the aforementioned embodiments will be designated by the same reference numerals, and thus the descriptions thereof shall be omitted here.

An image forming apparatus 60 in accordance with the present embodiment includes a developing device 64, a pulse motor 25 and a cleaning unit 66. The developing device 64 includes a photoreceptor drum 61 (photoreceptor), a transfer roller 62, a charging unit 63, and a developing roller 51 (developing material holding member).

The cleaning unit 66, the charger unit 63 and the developing device 64 are aligned in this order along the circumference of the photoreceptor drum 61 in contact therewith from the upstream side in a rotating direction of the photoreceptor drum 61. More specifically, the scraping plate of the cleaning unit 66, the charge brush of the charger unit 63, and the developing roller 51 of the developing device 64 are in contact with the photoreceptor drum 61. The transfer roller 62 is placed opposing the photoreceptor drum 61 to be in contact therewith having the transported sheet 5 in-between.

Two gears are mounted on a shaft of the photoreceptor drum 61: one is a drive gear (not shown) for receiving a drive force from the pulse motor 25, and the other is a photoreceptor gear 61*a* for driving the charger unit 63, the developing device 64 and the transfer roller 62. Namely, by the pulse motor 25, the photoreceptor drum 61 is actuated to rotate in a clockwise direction in the figure. The charger unit 63 having mounted thereon the charge gear 63*b* is connected to the photoreceptor gear 61*a*. Namely, the charger unit 63 is driven by the photoreceptor gear 61*a* through the charge gear 63*b*. The developing device 64 and the transfer roller 62 are driven by the photoreceptor gear 61*a*.

Here, by the spring 63*a*, the charge brush is made in tight contact with the photoreceptor drum 61. Further, by the spring 64*a* mounted on the upper portion of the developing device 64, the developing roller 51 is made in tight contact with the photoreceptor drum 61. Furthermore, the transfer roller 62 is made in tight contact with the photoreceptor drum 61 by the spring 62*a*.

The photoreceptor drum 61 of the present embodiment has the same structure as that of the previous embodiment. That is, the photoreceptor drum 61 is made of an aluminum cylindrical tube with a diameter of 24 mm and a thickness of 0.75 mm.

On the cylindrical tube, an organic photoconductive material wherein hydrazone is dispersed in an organic photoconductive material having a copolymer obtained by carrying out a graft polymerization of polycarbonate with polysiloxane unit as a side chain with a thickness of 20 μm is applied as the charge transport layer, and further an organic photoconductive material wherein fine particles of phthalocyanine are dispersed in polyvinyl butyral is formed thereon as a charge generating layer with a thickness of 0.5 μm. The resulting photoreceptor is used for the photoreceptor drum 61. The photoreceptor drum 61 is rotatably driven by a force from the pulse motor 25, which has been reduced by the three gears, and this rotary movement thereof is controlled at a peripheral speed of 25 mm/sec.

For the charge brush of the charger unit 63, a contact-type electrically conductive brush having a diameter of 12 mm is used. The charge brush is wound around a metal shaft with a diameter of 10 mm so as to have a diameter of 12 mm. The charge brush is made of electrically conductive fiber of a resistance value of $10^6$ Ω wherein carbon is dispersed in rayon. The electrically conductive fiber has a thickness of 10 μm, and a length of 4 mm. The density of the charge brush is 10,000 hairs/cm$^2$. The leading end of the electrically conductive fiber is curled by applying a heating process so as to have a diameter of 12 mm. The charge brush of the charger unit 63 is pressed by a spring 63*a* onto the photoreceptor drum 61 by a force of 200 gf. The charge brush rotates in an opposite direction to the rotating direction of the previous embodiment, i.e., rotates in the rotating direction of the photoreceptor drum 61 at a peripheral speed of 30 mm/sec.

For the transfer roller 62, an electrically conductive sponge roller with a diameter of 12 mm is used. Such sponge roller is made of a polyurethane having a carbon dispersed therein. The amount of carbon is selected such that the resistance value of the transfer roller 62 is $10^4$ Ω. The hardness of the transfer roller 62 is selected in a range of 40 degree and 50 degree in ASKER C. The transfer roller 62 is pressed by the spring 62*a* with a force of 1.5 kgf onto the photoreceptor drum 61.

The developing device 64 is pressed onto the photoreceptor drum 61 with a force of 800 gf by a spring 64*a* of the main body in the installed state in the main body of the image forming apparatus. As a result, there exits a nip width of 1.5 mm between the photoreceptor drum 61 and the transfer roller 62.

For the developing device 64, the non-magnetic one component developing system is employed as in the case of the developing device 24 of Embodiment 1. A developing roller 51 is provided so as to close the opening formed at bottom portion of the developer unit 50. The developing roller 51 rotates in an opposite direction from the photoreceptor drum 61 with a variable speed, to carry the non-magnetic toner of one component stored in the developer unit 50 to the developing area in contact with the photoreceptor drum 61.

On an upstream side with respect to the developing area, provided is a developing material layer thickness controlling member which is pressed onto the developing roller 51. The developing material layer thickness controlling member forms a toner layer entirely on the area in the shaft direction of the developing roller 51.

The developing roller 51 has a diameter of 16 mm, and is made in contact with the photoreceptor drum 61 with a predetermined nip width of 0.3 mm. The developing roller 51 is made of a material having a rubber elasticity to ensure a nip from the photoreceptor drum 61, such as an electrically conductive elastic silicone rubber. The developing roller 51 is selected to have a hardness of 75 degree in ASKER C and a resistance value of $10^6$ Ω. The developing material layer thickness controlling member is made of an iron having a rigidity and is pressed onto the developing roller 51 by a force of 30 gf/cm.

With respect to the image forming apparatus of the present embodiment, the same comparison is made between performances of the conventional photoreceptor and the photoreceptor of the present embodiment in the same manner as Embodiment 1. For the conventional photoreceptor, those conventional examples A and B used in the previous embodiment are used.

In the experiment, a pulse motor available from Matsushita Electric Industrial Co., Ltd. is used. The pulse motor is arranged so as to have a drive torque of 440 gf.cm under the conditions of input voltage of 12 V, a wire wound resistance of 7.8 Ω, and a current of 0.65 A.

In the experiment, with a variable ratio of the peripheral speed of the developing roller with respect to the photoreceptor, evaluations are made by monitoring a torque of the motor axis of the photoreceptor. This is because the largest torque among those observed by the torque of the motor axis of the photoreceptor is a slip torque caused by the difference in peripheral speed between the developing roller and the photoreceptor. With a variable ratio of the peripheral speed of the developing roller with respect to the photoreceptor from 1.0 to 1.7, results of comparison on torque on the motor axis between the conventional photoreceptor and the photoreceptor of the present embodiment are shown in Table 4.

TABLE 4

| PERIPHERAL SPEED RATIO | 1.0 | 1.3 | 1.5 | 1.7 |
|---|---|---|---|---|
| TORQUE OF CONVENTIONAL EXAMPLE (kgf · cm) | 0.12 | 0.15 | 0.19 | 0.22 |
| TORQUE OF EMBODIMENT 2 (kgf · cm) | 0.04 | 0.05 | 0.06 | 0.07 |

From the results shown in Table 4, it can be seen that when the peripheral speed ratio varies in the range of 1.0–1.7, the torque of the photoreceptor in the present embodiment is less than one third of that of the conventional photoreceptor.

With a variable ratio of the peripheral speed of the developing roller with respect to the photoreceptor, the uniformities of the half-tone image and the black image are evaluated. The results of these measurements are shown in Table 5.

TABLE 5

| PERIPHERAL SPEED | 1.0 | 1.3 | 1.5 | 1.7 |
|---|---|---|---|---|
| CONVENTIONAL PHOTORECEPTOR | ○ | Δ | x | x |
| PHOTORECEPTOR OF EMBODIMENT 2 | ○ | ○ | ○ | ○ |

Uniformity . . .
x : Very Poor (irregularity is observed both in pitch and in density)
Δ : Good (uniform density with irregularity in pitch)
○ : Excellent (uniform density without irregularity in pitch)

The results of the experiment show that in the case of the peripheral speed ratio of not less than 1.5, there shown unpreferable conditions of not only irregular rotary movement of the photoreceptor, but also poor image quality. In contrast, with regard to the photoreceptor of the present embodiment, even with the peripheral speed ratio of the developing roller with respect to the photoreceptor is 1.7, such unpreferable conditions of pitch error and uncontrolled density do not occur. Thus, the image forming apparatus 60 of the present embodiment offers desirable image without suffering from irregular rotary movement of the photoreceptor.

Additionally, the comparison between the results shown in Tables 2 and 3 of the first embodiment respectively with the results shown in Tables 4 and 5 of the present embodiment shows that large torque values are obtained both for the conventional photoreceptor and the photoreceptor of the present embodiment as compared to the first embodiment. On the other hand, an improved uniformity of the half-tone image is shown.

In the present embodiment, as the charge brush is rotated at a peripheral speed different from the peripheral speed of the photoreceptor using the charge gear, a force is exerted in a direction of stopping the rotary movement of the photoreceptor. Namely, the drive torque of the photoreceptor becomes large, and the apparent driving force of the photoreceptor by the developing roller becomes smaller. As a result, the photoreceptor can be prevented from being driven by the developing roller, and irregular rotary movement of the photoreceptor can be surely prevented.

Embodiment 3

Figure 4:
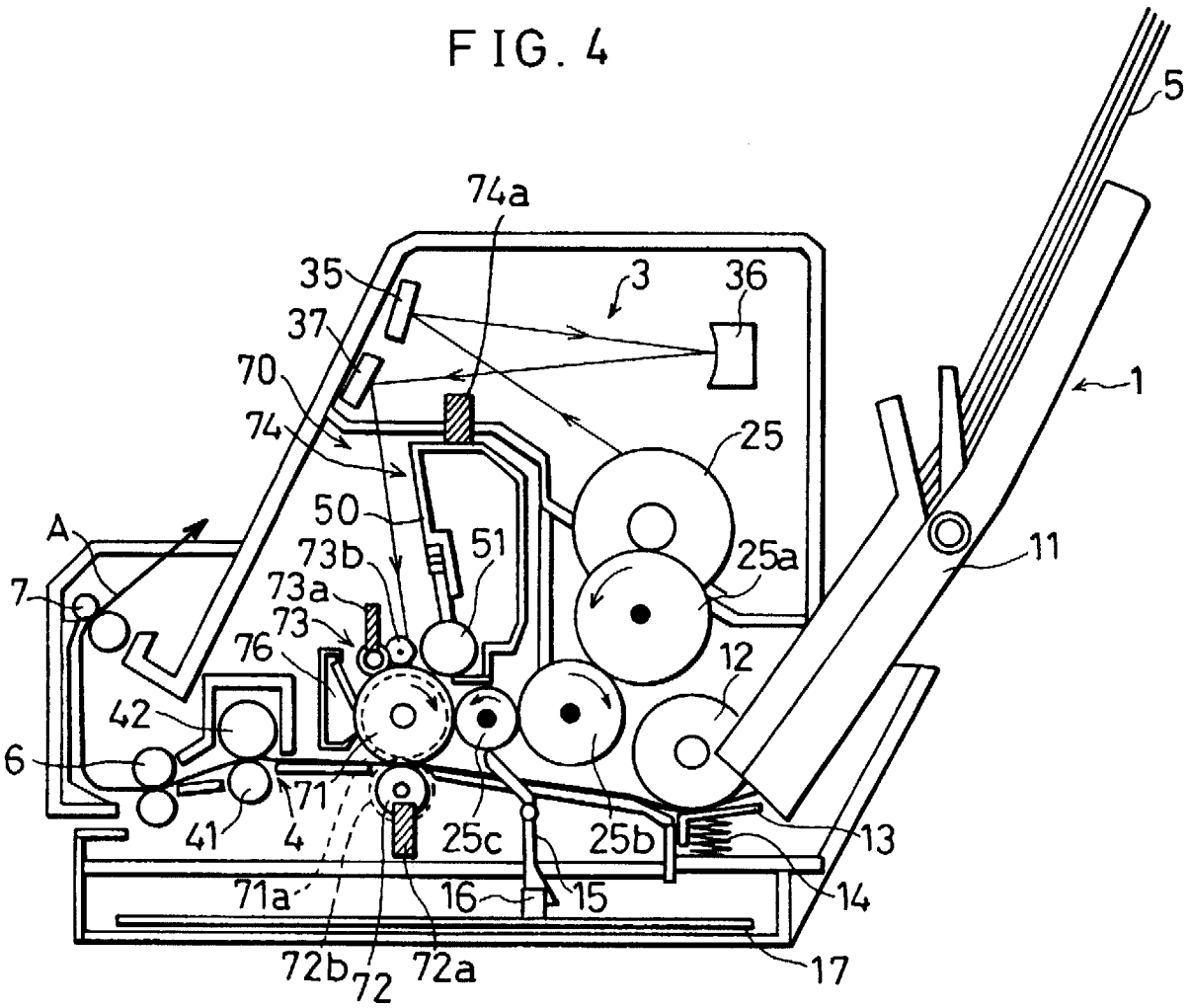
FIG. 4 is a view schematically showing a laser printer in accordance with still another embodiment of the present invention.
Figure 5:
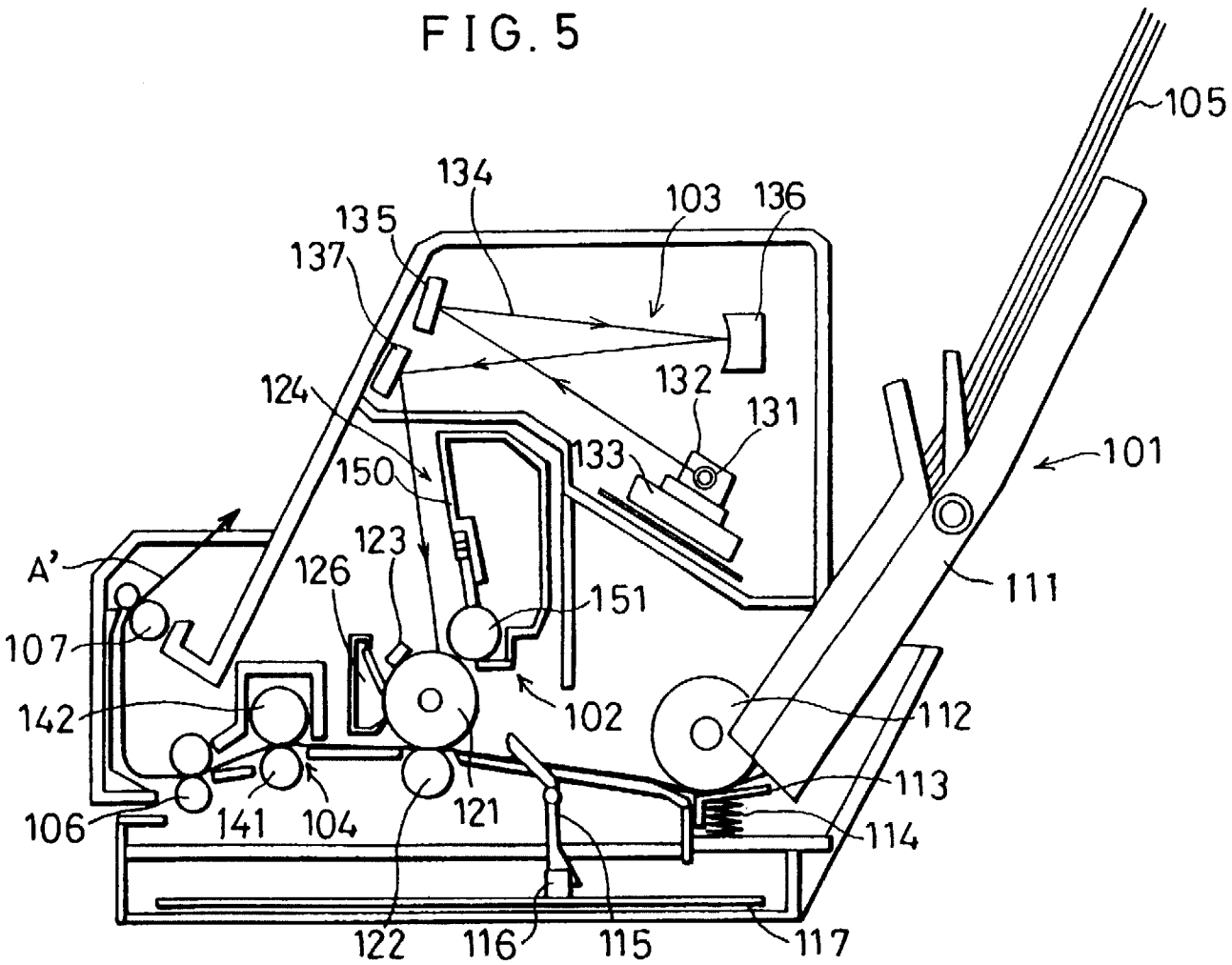
FIG. 5 is a view schematically showing a conventional laser printer.

The following descriptions will discuss still another embodiment of the present invention in reference to FIG. 4. For convenience in explanations, members having the same function as those of the aforementioned embodiments will be designated by the same reference numerals, and thus the descriptions thereof shall be omitted here. In the present embodiment, explanations are made through the case of adopting the image forming apparatus to the same laser printer as that of the first embodiment.

An image forming apparatus 70 of the present embodiment includes a developing device 72 which includes a photoreceptor drum 71 (photoreceptor), a transfer roller 72 (transfer member), a charging member 73 and a developing roller 51 (developing material holding member), a pulse motor 25 and a cleaning unit 76.

The cleaning unit 76, the charging member 73 and the developing unit 74 are placed in this order from the upstream side in the rotating direction of the photoreceptor drum 71 so as to be in contact with the peripheral surface of the photoreceptor. Specifically, the scraping plate of the cleaning unit 76, the charge brush of the charging member 73 and the developing roller 51 of the developing unit 74 are in contact with the photoreceptor drum 71. The transfer roller 72 is placed opposing the photoreceptor drum 71 with a transported sheet 5 (copying material) inbetween.

Two gears are mounted on a shaft of the photoreceptor drum 71: one is a drive gear (not shown) for receiving a drive force from the pulse motor 25, and the other is a photoreceptor gear 71*a* for driving the photoreceptor drum 71. Namely, by the pulse motor 25, the photoreceptor drum 71 is controlled to rotate in a clockwise direction in the figure. The transfer gear 72*b* is provided on the transfer roller 72 and is connected to the photoreceptor gear 71*a*. Namely, the transfer roller 72 is driven by the photoreceptor gear 71*a* through the transfer gear 72*b*. The developing device 74 and the charging member 73 are driven by another gear.

Here, by the spring 73a, the charge brush is made in tight contact with the photoreceptor. Further, by the spring 74a mounted on the upper portion of the developing device 74, the developing roller 51 is made in tight contact with the photoreceptor drum 71. Furthermore, the transfer roller 72 is made in tight contact with the photoreceptor drum 71 by the spring 72a.

The photoreceptor drum 71 of the present embodiment has the same structure as that of the previous embodiment. That is, the photoreceptor drum 71 is made of an aluminum cylindrical tube with a diameter of 24 mm and a thickness of 0.75 mm.

On the cylindrical tube, an organic photoconductive material wherein hydrazone is dispersed in an organic photoconductive material having a copolymer obtained by carrying out a graft polymerization of polycarbonate with polysiloxane unit as a side chain with a thickness of 20 μm is applied as the charge transport layer, and further an organic photoconductive material wherein fine particles of phthalocyanine are dispersed in polyvinyl butyral is formed thereon as a charge generating layer with a thickness of 0.5 μm. The resulting photoreceptor is used for the photoreceptor drum 71. The photoreceptor drum 71 is rotatably driven by a force from the pulse motor 25, which has been reduced by the described three gears, and this rotary movement thereof is controlled at a peripheral speed of 25 mm/sec.

For the charge brush of the charger unit 73, a contact-type brush and an electrically conductive brush are used. The charge brush is wound around a metal shaft with a diameter of 10 mm so as to have a diameter of 12 mm. The charge brush is made of electrically conductive fiber of a resistance value of $10^6$ wherein carbon is dispersed in rayon. The electrically conductive resin has a thickness of 10 μm, and a length of 4 mm. The density of the charge brush is 10,000 hairs/cm$^2$. The charge brush of the charger unit 73 is pressed by a spring 73a onto the photoreceptor drum 71 by a force of 200 gf. The charge brush rotates in an opposite direction of the rotating direction of the previous embodiment, i.e., in the direction of the photoreceptor drum 71 at a peripheral speed of 30 mm/sec.

For the transfer roller 72, an electrically conductive sponge roller with a diameter of 12 mm is used. Such sponge roller is made of a polyurethane having a carbon dispersed therein. The amount of carbon is selected such that the resistance value of the transfer roller 72 is $10^4$ Ω. The hardness of the transfer roller 72 is selected to be within 40 degree to 50 degree in ASKER C. The transfer roller 72 is pressed with a force of 1.5 kgf by the spring 72a onto the photoreceptor drum 71.

The developing device 74 is pressed onto the photoreceptor drum 71 by a force of 800 gf by a spring 74a of the main body in the installed state in the main body of the image forming apparatus. As a result, there exits a nip width of 1.5 mm between the photoreceptor drum 71 and the transfer roller 72.

The transfer roller 72 is driven by the photoreceptor gear 71a at a peripheral speed of 26 mm/sec. Namely, the transfer roller 72 slightly and quickly rotates in an opposite direction to the photoreceptor drum 71. Therefore, the transfer roller 72 is rotated while being slipped with the photoreceptor drum 71. This is to improve the transfer efficiency of the toner onto the sheet 5 by slipping the transfer roller 72 and the photoreceptor drum 71. Here, the ratio of the peripheral speed of the photoreceptor drum 71 to the transfer roller 72 can be adjusted by adjusting, for example, the diameter of the transfer gear, etc.

For the developing device 74, the non-magnetic one component developing device is employed as in the case of the developing device 24 of the aforementioned Embodiment 1. A developing roller 51 is provided so as to close the opening formed at bottom portion of the developer unit 50. The developing roller 51 rotates in an opposite direction from the photoreceptor drum 71 with a variable speed, to carry the non-magnetic toner of one component stored in the developer unit 50 to the developing area in contact with the photoreceptor drum 71. On an upstream side with respect to the developing area, provided is a developing material layer thickness controlling member which is pressed onto the developing roller 51. The developing material layer thickness controlling member forms a uniform toner layer entirely on the area in the shaft direction of the developing roller 51.

The developing roller 51 has a diameter of 16 mm, and is made in contact with the photoreceptor drum 71 with a predetermined nip width of 0.3 mm therebetween. The developing roller 51 is made of a material having a rubber elasticity to ensure a nip from the photoreceptor drum 71, such as an electrically conductive elastic silicone rubber. The developing roller 51 is selected to have a hardness of 75 degree measured by ASKER C and a resistance value of $10^6$ Ω. The developing material layer thickness controlling member is made of an iron having a rigidity and is pressed onto the developing roller 51 by a force of 30 gf/cm.

With respect to the image forming apparatus 70 of the present embodiment, the same comparison is made on performances of the conventional photoreceptor and the photoreceptor drum 71 of the present embodiment in the same manner as Embodiment 1. For the conventional photoreceptor, conventional photoreceptors A and B used in the previous embodiment are used.

In the experiment, a pulse motor available from Matsushita Electric Industrial Co., Ltd. is used. The pulse motor is arranged so as to have a drive torque of 440 gf cm under the conditions of an input voltage of 12 V, a wire wound resistance of 7.8 Ω, and a current of 0.65 A.

In the experiment, with a variable ratio of the peripheral speed of the developing roller with respect to the photoreceptor, evaluations are made by monitoring a torque of the motor axis of the photoreceptor. This is because the largest torque among those observed by the torque of the motor axis of the photoreceptor is a slip torque caused by the difference in peripheral speed between the developing roller and the photoreceptor. With a variable ratio of the peripheral speed of the developing roller with respect to the photoreceptor from 1.0 to 1.7, results of comparison on torque on the motor axis between the conventional photoreceptor and the photoreceptor of the present embodiment are shown in Table 6.

TABLE 6

| PERIPHERAL SPEED RATIO | 1.0 | 1.3 | 1.5 | 1.7 |
|---|---|---|---|---|
| CONVENTIONAL TORQUE (kgf · cm) | 0.13 | 0.16 | 0.20 | 0.23 |
| TORQUE OF EMBODIMENT 3 (kgf · cm) | 0.04 | 0.06 | 0.07 | 0.08 |

From the results shown in Table 6, it can be seen that with a variable ratio of the peripheral speed in the range of 1.0–1.7, the torque of the photoreceptor in the present embodiment is less than one third of that of the conventional photoreceptor.

Next, with a variable peripheral speed ratio of the developing roller with respect to the photoreceptor, the uniformities of a half-tone image and a black image are respectively evaluated. The results of these measurements are shown in Table 7.

TABLE 7

| PERIPHERAL SPEED RATIO | 1.0 | 1.3 | 1.5 | 1.7 |
|---|---|---|---|---|
| CONVENTIONAL PHOTORECEPTOR | ○ | ○ | Δ | x |
| PHOTORECEPTOR OF EMBODIMENT 3 | ○ | ○ | ○ | ○ |

Uniformity . . .
x : Very Poor (irregularity is observed both in pitch and in density)
Δ: Good (uniform density with irregularity in pitch)
○: Excellent (uniform density without irregularity in pitch)

The results of the experiment show that in the case of the peripheral speed ratio of not less than 1.5 in the conventional photoreceptor, there shown unpreferable conditions of not only irregular rotary movement of the photoreceptor, but also poor image quality. In contrast, with regard to the photoreceptor of the present embodiment, even with the peripheral speed ratio of the developing roller to the photoreceptor of 1.7, such unpreferable conditions of pitch error and uncontrolled density do not occur. Thus, the image forming apparatus 70 of the present embodiment offers desirable images without suffering from irregular rotations of the photoreceptor.

Additionally, the comparison between the results shown in Tables 4 and 5 of the second embodiment respectively with the results shown in Tables 6 and 7 of the present embodiment shows that large torque values are obtained in the present embodiment both for the conventional photoreceptor and the photoreceptor of the present embodiment as compared to the second embodiment. On the other hand, an improved uniformity of the half-tone image is obtained. The described effect can be achieved for the following mechanism. As the transfer roller 72 slips by selecting a different peripheral speed of the transfer roller 72 from a peripheral speed of the photoreceptor drum by means of the transfer gear **72*b*, a drive torque of the photoreceptor drum should be high by the driving of the transfer roller 72, and the apparent driving force of the photoreceptor drum by the developing roller 51 becomes smaller. As a result, the photoreceptor drum can be prevented from being driven by the developing roller 51**, and the irregular rotations of the photoreceptor drum can be prevented.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic image forming apparatus for forming an image by developing an electrostatic latent image formed on a photoreceptor using a developing material, said apparatus comprising:

a cylindrical photoreceptor which is rotatably driven; and a developing material holding member having an elastic material for holding a developing material on a surface thereof during its rotary movement, said developing material holding member supplying a developing material on said photoreceptor while contacting a peripheral surface of said photoreceptor, wherein said photoreceptor is placed in such a manner that a coefficient of dynamic friction between said photoreceptor and said elastic material is not more than 0.5.

2. The electrophotographic image forming apparatus as defined in claim 1, further comprising:

a charging member for uniformly charging the surface of said photoreceptor during its rotary movement, said charging member being provided on an upstream side of said developing material holding member with respect to a rotating direction of said photoreceptor so as to be in contact with the peripheral surface of said photoreceptor; and charging member control means for controlling said charging member to rotate at a different peripheral speed from a peripheral speed of said photoreceptor.

3. The electrophotographic image forming apparatus as defined in claim 2, wherein said charging member control means includes a photoreceptor gear mounted on said photoreceptor for actuating a rotary movement of said photoreceptor, and a charge gear mounted to said charging member, said charge gear being engaged with said photoreceptor gear for actuating a rotary movement of said charging member by the rotary movement of said photoreceptor.

4. The electrophotographic image forming apparatus as defined in claim 2, wherein:

said charging member control means controls said charging member so as to rotate at faster peripheral speed than a peripheral speed of said photoreceptor.

5. The electrophotographic image forming apparatus as defined in claim 2, wherein:

said charging member is a charge brush in tight contact with said photoreceptor.

6. The electrophotographic image forming apparatus as defined in claim 5, wherein:

said charge brush is made of an electrically conductive fiber wherein carbon is dispersed in rayon.

7. The electrophotographic image forming apparatus as defined in claim 1, further comprising:

a transfer member in contact with a peripheral circumference of said photoreceptor, for transferring the developing material on said photoreceptor to the copying material by a rotary movement thereof, said transfer member opposing said photoreceptor having a transportation path for the copying material inbetween; and transfer member control means for controlling the transfer member to rotate at different peripheral speed from a peripheral speed of said photoreceptor.

8. The electrophotographic image forming apparatus as defined in claim 7, wherein said transfer member control means includes:

a photoreceptor gear mounted to said photoreceptor for actuating a rotary movement thereof, and a transfer gear mounted to said charging member, said transfer gear being engaged with said photoreceptor gear for actuating a rotary movement of said charging member by the rotary movement of said photoreceptor.

9. The electrophotographic image forming apparatus as defined in claim 7, wherein:

said transfer member control means controls said transfer member to rotate at faster peripheral speed than a peripheral speed of said photoreceptor.

10. The electrophotographic image forming apparatus as defined in claim 7, wherein:

said transfer member is a transfer roller in tight contact with said photoreceptor.

11. The electrophotographic image forming apparatus as defined in claim 10, wherein:

said transfer member is made of an electrically conductive resin wherein carbon is dispersed in polyurethane.

12. The electrophotographic image forming apparatus as defined in claim 1, wherein:

said photoreceptor has a photoconductive layer made of an organic photoconductive material formed on a cylindrical tube.

13. The electrophotographic image forming apparatus as defined in claim 12, wherein:

said photoconductive layer includes a charge transport layer having a charge generating layer including a charge generating substance and a charge transport layer having a charge transport substance dispersed in a binder resin.

14. The electrophotographic image forming apparatus as defined in claim 13, wherein:

said binder resin includes at least one element selected from a group consisting of a copolymer of polycarbonate obtained by a block-polymerization of polycarbonate with a polysiloxane unit as a main chain, and a polycarbonate copolymer obtained by carrying out a graft-polymerization of a polycarbonate with a polysiloxane unit as a side chain.

15. The electrophotographic image forming apparatus as defined in claim 1, wherein:

a surface layer of said photoreceptor in contract with said developing material holding member includes at least one element selected from a group consisting of a copolymer of polycarbonate obtained by carrying out a block-polymerization of polycarbonate with a polysiloxane unit as a main chain, and a polycarbonate copolymer obtained by carrying out a graft-polymerization of polycarbonate with the polysiloxane unit as a side chain.

16. The electrophotographic image forming apparatus as defined in claim 1, wherein:

the surface of said photoreceptor in contact with said developing material holding member includes a solid lubricant material.

17. The electrophotographic image forming apparatus as defined in claim 1, wherein:

the surface of said photoreceptor in contact with said developing material holding member includes a resin obtained by a graft-polymerization of a macromer including a alkylene fluoride side chain with a polymer.

18. The electrophotographic image forming apparatus as defined in claim 1, wherein:

the surface of said photoreceptor in contact with said developing material holding member includes a resin obtained by a graft polymerization of a macromer including a silicone side chain with a polymer.

19. The electrophotographic image forming apparatus as defined in claim 1, wherein:

said developing material is non-magnetic toner of one component.

20. The electrophotographic image forming apparatus as defined in claim 1, wherein:

said developing material holding member is a developing roller in tight contact with said photoreceptor.

21. The electrophotographic image forming apparatus as defined in claim 20, wherein:

a ratio of a peripheral speed of said developing material holding member to a peripheral speed of said photoreceptor is in a range of from 1.0 to 1.7.

22. The electrophotographic image forming apparatus as defined in claim 1, wherein:

said developing material holding member is made of an elastic material having a hardness in a range from 50 to 90 degree in ASKER C.

23. The electrophotographic image forming apparatus as defined in claim 1, wherein:

said developing material holding member is made of an urethane rubber having applied thereto an electrical conductivity.

24. The image forming apparatus as set from in claim 1, wherein:

a coefficient of dynamic friction between said photoreceptor and said elastic material is measured based on an tensile force of said photoreceptor and a pressing force applied onto the elastic material which is measured when said elastic material is pressed onto a photoreceptor sheet and said photoreceptor sheet is placed under tension.

25. A electrophotographic photoreceptor for use in an electrophotographic image forming apparatus which supplies a developing material on said photoreceptor by rotating a developer material holding member for holding the developing material while bringing it in contact with said photoreceptor, comprising:

a cylindrical tube which is capable of rotating; and a photoconductive layer formed so as to cover said cylindrical tube, wherein said photoconductive layer has a coefficient of dynamic friction of not more than 0.5 with respect to said developing material holding member.

26. The electrophotographic photoreceptor as defined in claim 25, wherein:

said photoconductive layer is composed of an organic photoconductive material.

27. An electrophotographic image forming apparatus for forming an image by developing an electrostatic latent image formed on a photoreceptor using a developing material, said apparatus comprising:

a cylindrical photoreceptor which is rotatably driven; and a developing material holding member having an elastic material for holding a developing material comprising a toner on a surface thereof during its rotary movement, said developing material holding member supplying a developing material on said photoreceptor while contacting a peripheral surface of said photoreceptor, wherein said photoreceptor is placed in such a manner that a coefficient of dynamic friction between said photoreceptor and said elastic material is not more than 0.5.

28. A photoreceptor having a photoconductive layer for use in an electrophotographic image forming apparatus which supplies a developing material comprising a toner on the photoreceptor by rotating a developer material holding member having an elastic material for holding the developing material while bringing it in contact with the photoreceptor, said photoreceptor comprising:

a cylindrical tube which is capable of rotating;

wherein the photoconductive layer is formed to cover said cylindrical tube, and wherein said photoconductive layer has a coefficient of dynamic friction of not more than 0.5 with respect to said elastic material.

* * * * *

UNITED STATES PATENT AND TRADEMARK OFFICE

CERTIFICATE OF CORRECTION

PATENT NO. : 5,778,286

DATED : July 7,1998

INVENTOR(S) : Kido, et al.

It is certified that error appears in the above-identified patent and that said Letters Patent is hereby corrected as shown below:

On the title page, item[73], insert:

--Assignee: Sharp Kabushiki Kaisha
22-22, Nagaike-Cho, Abeno-ku
Osaka 545, JAPAN Mitsubishi Chemical Corporation
5-2, Marunouchi 2-Chome, Chiyoda-ku
Tokyo 100, JAPAN Signed and Sealed this Thirteenth Day of July, 1999

*Attest:*

*Attesting Officer*

Q. TODD DICKINSON

*Acting Commissioner of Patents and Trademarks*